US006871766B2

(12) United States Patent
Nordstrom

(10) Patent No.: US 6,871,766 B2
(45) **Date of Patent: *Mar. 29, 2005**

(54) PIVOTING SHOULDER STRAP FOR A BACKPACK

(75) Inventor: Mark B. Nordstrom, Brentwood, TN (US)

(73) Assignee: TRG Accessories, L.L.C., St. Louis, MO (US)

( * ) Notice: Subject to any disclaimer, the term of this patent is extended or adjusted under 35 U.S.C. 154(b) by 245 days.

This patent is subject to a terminal disclaimer.

(21) Appl. No.: 10/085,397

(22) Filed: Feb. 28, 2002

(65) Prior Publication Data

US 2003/0160079 A1 Aug. 28, 2003

(51) Int. Cl.[7] ..... A01K 97/04
(52) U.S. Cl. ..... 224/197; 224/604; 224/631
(58) Field of Search ..... 224/197, 199, 224/604, 627, 631, 257, 259, 632, 634, 578, 579, 586, 258, 191, 196

(56) References Cited

U.S. PATENT DOCUMENTS

| | | | | | |
|---|---|---|---|---|---|
| 1,318,850 | A | | 10/1919 | DeYong | |
| 1,403,167 | A | * | 1/1922 | Kahlow | 16/114.1 |
| 4,271,999 | A | | 6/1981 | Stravitz | |
| 4,660,751 | A | * | 4/1987 | von Dewitz | 224/632 |
| 4,718,586 | A | | 1/1988 | Hagino | |
| 4,860,936 | A | * | 8/1989 | Lowe | 224/632 |
| 5,004,135 | A | * | 4/1991 | Dufournet et al. | 224/632 |
| 5,449,102 | A | * | 9/1995 | Sason | 224/632 |
| 5,732,867 | A | | 3/1998 | Perkins et al. | |
| 5,806,146 | A | | 9/1998 | Chen | |
| 5,860,769 | A | | 1/1999 | Seligman | |
| 5,988,475 | A | | 11/1999 | Han | |
| 6,006,974 | A | | 12/1999 | Varney et al. | |
| 6,059,156 | A | | 5/2000 | Lehtinen | |
| 6,305,535 | B1 | | 10/2001 | Fair | |
| 6,457,620 | B1 | | 10/2002 | Batten et al. | |
| 6,460,746 | B1 | * | 10/2002 | Amram | 224/579 |
| 6,474,523 | B2 | * | 11/2002 | Morrison et al. | 224/578 |
| 2001/0025867 | A1 | | 10/2001 | Chuange | |
| 2002/0088836 | A1 | | 7/2002 | Battern et al. | |

FOREIGN PATENT DOCUMENTS

| | | | | |
|---|---|---|---|---|
| FR | 002312212 A1 | * | 1/1977 | 224/209 |

* cited by examiner

*Primary Examiner*—Stephen K. Cronin
(74) *Attorney, Agent, or Firm*—Lewis, Rice & Fingersh L.C.

(57) ABSTRACT

A pivoting shoulder strap for a backpack comprises a retaining plate positioned within the backpack, a shoulder strap having a first end and a second end, the first end adapted to being connected to the backpack, and a pivoting mechanism positioned on the second end of the shoulder strap and adapted to being mated to the retaining plate.

15 Claims, 7 Drawing Sheets

PIVOTING SHOULDER STRAP FOR A BACKPACK

BACKGROUND OF THE INVENTION

This invention relates to a device for securing a shoulder strap to a backpack and more particularly to a pivoting or ratcheting shoulder strap for a backpack.

Backpacks for carrying items such as clothing, food, camping supplies, personal items, or books typically include a pack having a pair of shoulder straps or a shoulder harness and a hip belt. Another basic type of backpack includes a pack having an interior frame assembly and a pair of shoulder straps. One problem associated with the use of any of these backpacks is that when the backpack is heavily loaded carrying the backpack for any period of time is very tiring and uncomfortable. Some known backpacks that have attempted to solve this problem have employed shoulder straps that are allowed to swing with the movement of the person carrying the pack. However, such shoulder straps have proven to be undesirable because the components used tend to stretch or loosen over time. Further, such shoulder straps have all of the components on the outside of the backpack where such components may be damaged or become tangled. Additionally, with shoulder straps that are allowed to move, it is important that the degree of movement be restricted so that during use the backpack is not jerked around the back or neck.

It is also sometimes common to carry the backpack in the hands by use of the shoulder straps. Use of the backpack in this manner can be uncomfortable and tiring on the hands. Sometimes the backpack is worn on one shoulder and due to the weight of the pack being only on one shoulder, the backpack is periodically switched to the other shoulder. A pivoting shoulder strap would aid in the comfort and use of a backpack when the backpack is carried in the hands or over a single shoulder.

The present invention is designed to obviate and overcome many of the disadvantages and shortcomings associated with prior shoulder straps for backpacks. In particular, the present invention is an improved shoulder strap for a backpack that provides for pivotal movement of the shoulder straps relative to the backpack. Moreover, the present invention allows an individual to wear a backpack for a longer period of time with greater comfort and less fatigue. The shoulder strap for a backpack of the present invention provides a shoulder strap to ratchet or move through a predetermined degree of motion when a backpack is being used by an individual.

SUMMARY OF THE INVENTION

In one form of the present invention, a pivotal shoulder strap for a backpack comprises a retaining plate positioned within the backpack, a shoulder strap having a first end and a second end, the first end adapted to being connected to the backpack, and a pivoting mechanism positioned on the second end of the shoulder strap and adapted to being mated to the retaining plate.

In another form of the present invention, a ratcheting shoulder strap for a backpack comprises a retaining plate positioned within the backpack, a shoulder strap having a first end and a second end, the first end adapted to being connected to the backpack, and a ratcheting mechanism positioned on the second end of the shoulder strap and adapted to being mated to the retaining plate, the ratcheting mechanism for moving the shoulder strap relative to the retaining plate in a predetermined degree of movement.

In yet another form of the present invention, a pivotal shoulder strap for a backpack comprises a retaining plate positioned in the backpack, a shoulder strap having a first end and a second end, the first end adapted to being connected to the backpack, and a pivoting mechanism attached to the second end of the shoulder strap and adapted to being connected to the retaining plate, the pivoting mechanism comprising a base plate and a pivoting plate which is retained within the base plate, the pivoting mechanism for moving the shoulder strap relative to the retaining plate in a predetermined degree of motion.

In light of the foregoing comments, it will be recognized that a principal object of the present invention is to provide a pivoting shoulder strap for a backpack which is of simple construction and design and which can be easily employed with highly reliable results.

Another object of the present invention is to provide a pivotal shoulder strap for a backpack which is constructed using durable parts or components.

A further object of the present invention is to provide a pivotal should strap for a backpack that adjusts and conforms to back and neck of a user.

Another object of the present invention is to provide a pivoting shoulder strap for a backpack that is easy to adjust and use.

A still further object of the present invention is to provide a pivoting should strap for a backpack that can be incorporated into existing backpacks with minimal change.

These and other objects and advantages of the present invention will become apparent after considering the following detailed specification in conjunction with the accompanying drawings, wherein:

DETAILED DESCRIPTION OF THE PREFERRED EMBODIMENTS

Figure 1:
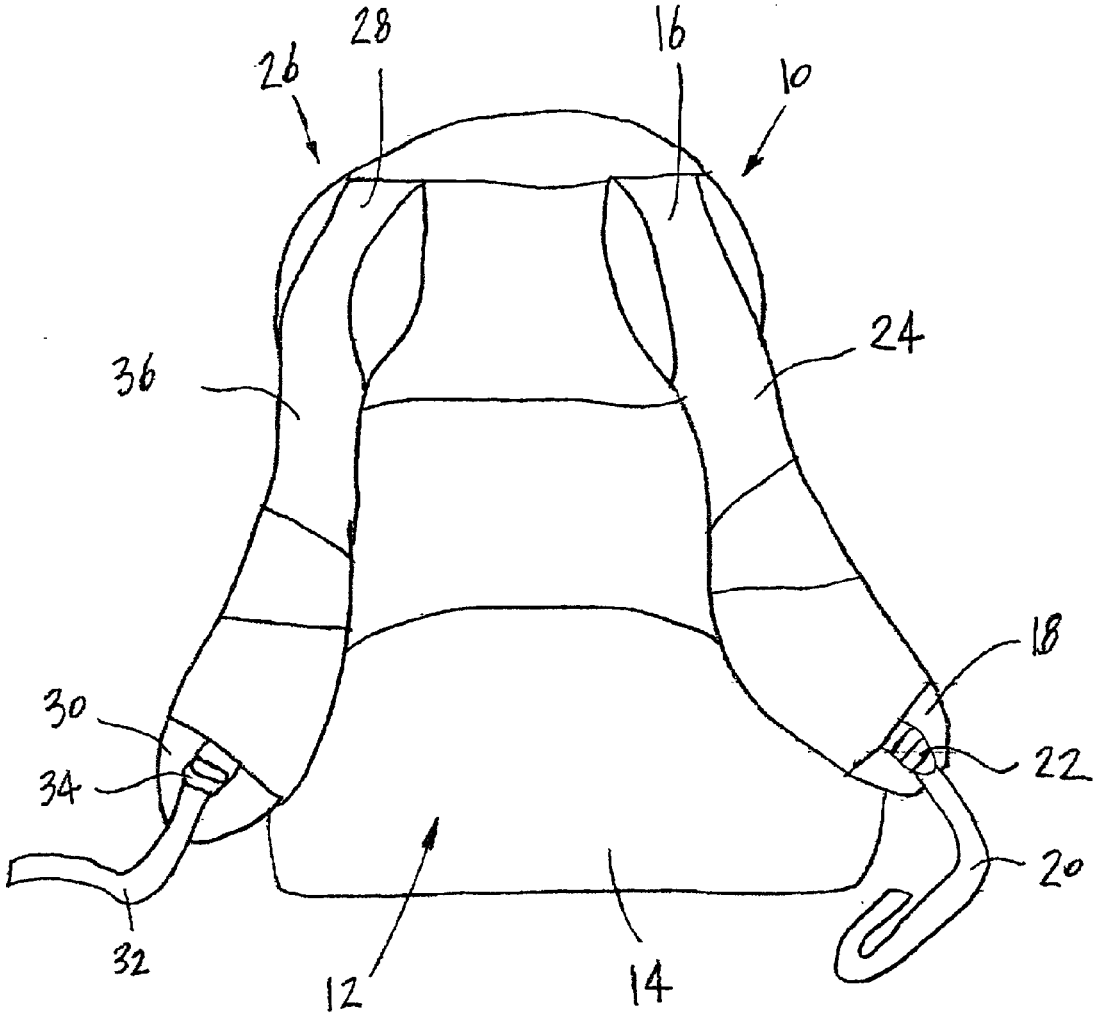
FIG. 1 is a front perspective view of a preferred embodiment of a pivoting shoulder strap for a backpack constructed according to the present invention.

Referring now to the drawings, wherein like numbers refer to like items, number 10 identifies a preferred embodiment of a pivoting shoulder strap for a backpack constructed according to the present invention. With reference now to FIG. 1, the pivoting shoulder strap for a packback 10 is shown incorporated as part of a backpack 12. The backpack 12 comprises a pack portion 14 which may include a front flap (not shown) for gaining access to the interior of the pack portion 14 and various other pockets, none of which are illustrated. The shoulder strap 10 has an upper portion 16 which may be attached to the backpack 12, as will be described herein. The shoulder strap 10 also has a lower portion 18 having an adjustable strap 20 and a buckle 22. The adjustable strap 20 may be connected to the backpack 12. The shoulder strap 10 further comprises a cover 24 which may be constructed of any suitable covering material such as nylon.

The backpack 12 has another shoulder strap 26 that is similar in construction to the shoulder strap 10. The shoulder strap 26 has an upper portion 28 that is connected to the backpack 12 and a lower portion 30 having an adjustable strap 32 and a buckle 34. The shoulder strap 26 also has a cover 36. Both of the shoulder straps 10 and 26 are capable of pivoting or ratcheting through a degree of motion about the backpack 12, as will be explained in detail herein.

Figure 2:
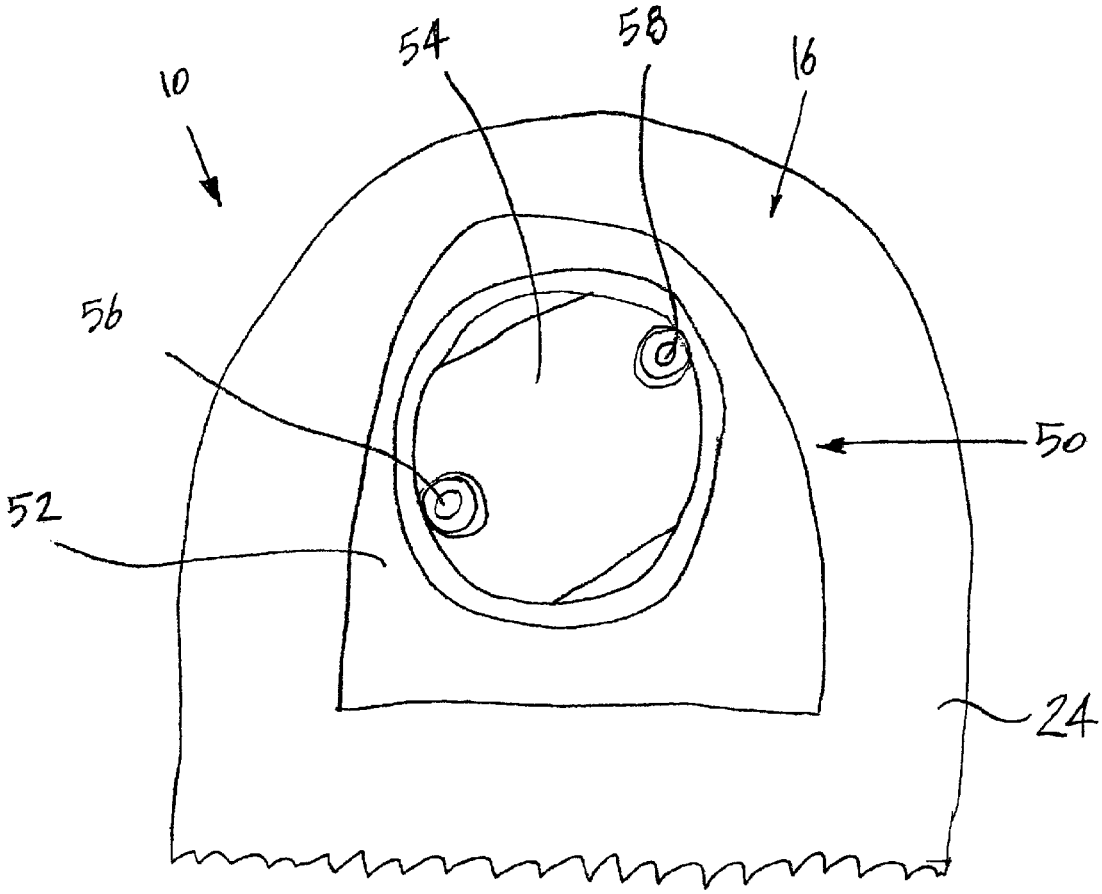
FIG. 2 is a front view of a pivoting mechanism for a pivoting shoulder strap for a backpack constructed according to the present invention.

With reference now to FIG. 2, an enlarged front view of a pivoting or ratcheting mechanism 50 is shown connected to the cover 24 of the upper portion 16 of the shoulder strap 10. The pivoting mechanism 50 may be connected to the cover 24 by any suitable method, such as sewing, gluing, stapling, heat welding, or fusing. The pivoting mechanism 50 comprises a base plate 52 and a pivoting plate 54. The pivoting plate 54 is configured or constructed to pivot or ratchet within the base plate 52. The base plate 52 is sized and shaped to capture the pivoting plate 54. The pivoting plate 54 also has a pair of screw holes 56 and 58 which are used to received screws (not shown), as will be discussed. The pivoting mechanism 50 may be constructed from any suitable material such as a high density polypropylene. Other material may be used such as plastic, rubber, metal, or combinations of such materials.

Figure 3:
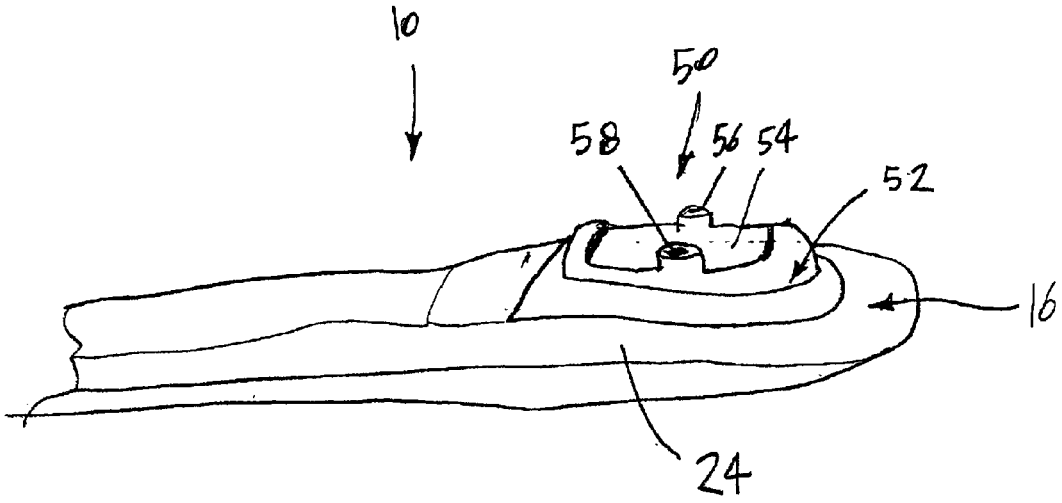
FIG. 3 is a reduced side view of the pivoting mechanism shown in FIG. 2.

FIG. 3 shows a reduced side view of the pivoting mechanism 50 depicted in FIG. 2. The pivoting mechanism 50 is connected to the cover 24 of the upper portion 16 of the shoulder strap 10. The pivoting mechanism 50 has the base plate 52 and positioned within the base plate 52 is the pivoting plate 54. The pivoting plate 54 is captured within the base plate 52 and is capable of rotating within the base plate 52. The pivoting plate 54 also has the two screw holes 56 and 58.

Figure 4:
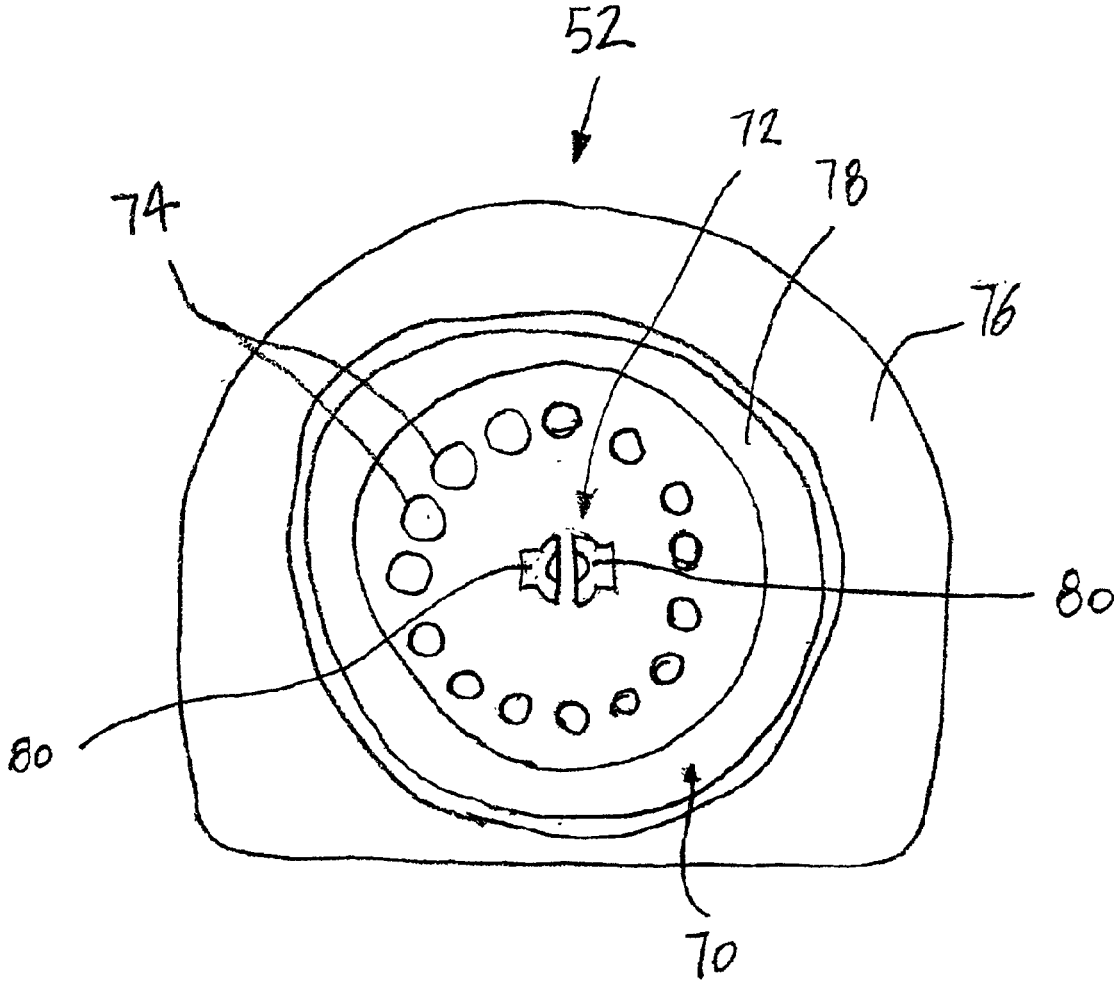
FIG. 4 is a top view of the pivoting mechanism with the pivoting plate removed.

Referring now to FIG. 4, a top perspective view of the base plate 52 with the pivoting plate 54 removed is illustrated. The base plate 52 includes an outer retaining ring 70, a centrally positioned retaining clip 72, a plurality of radially aligned apertures or holes 74, and a plate 76. As previously indicated, the plate 76 may be connected, attached, or adhered to the cover 24 of the shoulder strap 10. The outer retaining ring 70 is sized and shaped to capture the pivoting plate 54 by use of a peripheral lip 78. As will be explained, although the apertures 74 are shown encircling the plate 76, it is also possible that the apertures 74 only encircle a portion of the plate 76. For example, the apertures 74 may only form a semi-circle, a quarter of a circle, or any arc thereof. By further way of example, the apertures 74 may be spaced apart by a predetermined number of degrees, such as fifteen degrees. Further, the retaining clip 72 has a pair of retaining ears or tabs 80.

Figure 5:
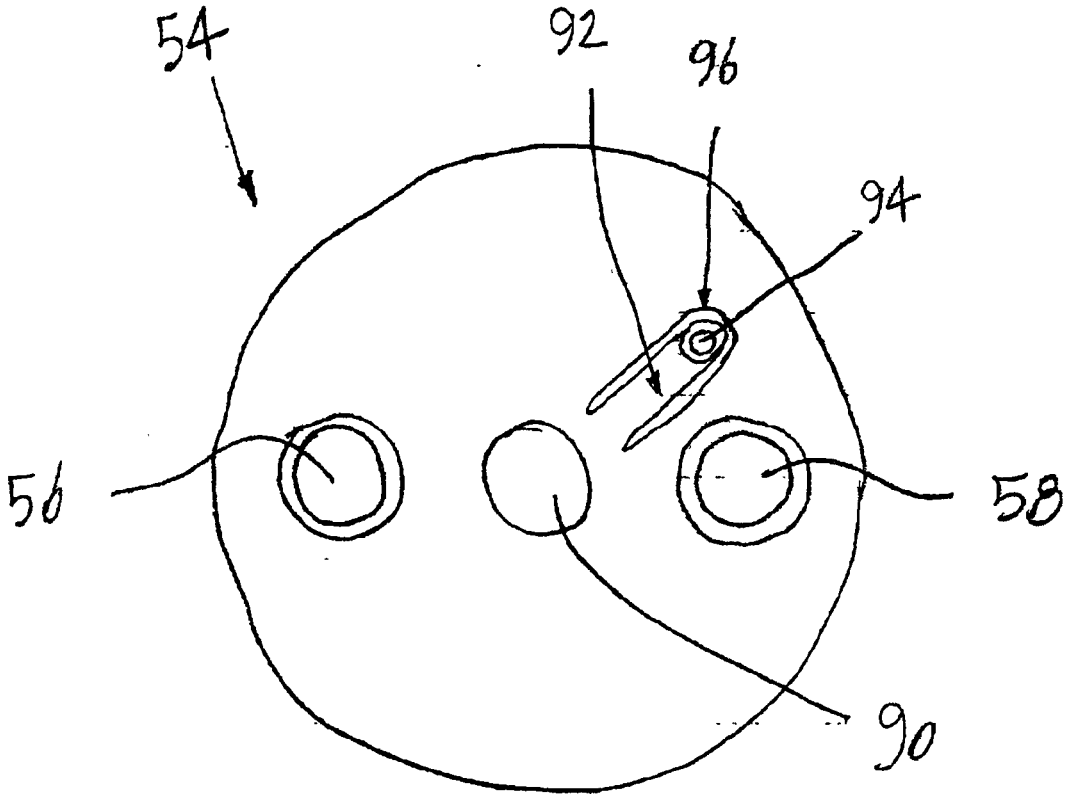
FIG. 5 is a top view of a pivoting plate for the pivoting shoulder strap constructed according to the present invention.

FIG. 5 illustrates a top view of the pivoting plate 54. The pivoting plate 54 has the screw holes 56 and 58 and also a centrally located aperture 90. The aperture 90 is designed to mate with the centrally positioned clip 72 of the base plate 52. The clip 72 and the tabs 80 are capable of retaining the pivoting plate 54 in place relative to the base plate 52 and allow the pivoting plate 54 to pivot about the clip 72 and the tabs 80. The pivoting plate 54 further comprises a tongue portion 92 having a detent or tab portion 94 at an end 96 of the tongue portion 92. The tab portion 94 is capable of mating with the apertures 74 of the base plate 52. As can be appreciated, movement of the pivoting plate 54 relative to the base plate 52 about the clip 72 will position the tab portion 94 into one of the apertures 74. The tongue portion 94 is resilient and is capable of bending or flexing when some pressure is exerted against the pivoting plate 54. By moving applying some pressure to the pivoting plate 54, the tab portion 94 may be released from one of the apertures 74 to move the pivoting plate 54 and the tab portion 94 into engagement with another one of the apertures 74. In this manner, the pivoting plate 54 is capable of ratcheting or pivoting about the base plate 52.

Figure 6:
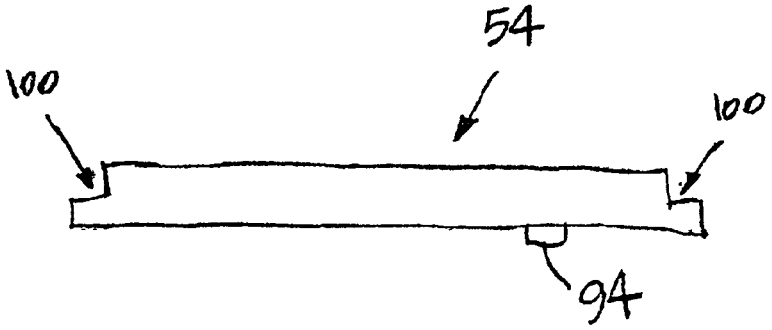
FIG. 6 is a side view of the pivoting plate shown in FIG. 5.

With particular reference now to FIG. 6, a side view of the pivoting plate 54 is shown. The pivoting plate 54 comprises a peripheral ledge 100 which is sized and shaped to fit within the outer retaining ring 70. The tab portion 94 is also shown extending out from the plate 54 and in this manner is capable of mating with the apertures 74 of the base plate 52.

Figure 7:
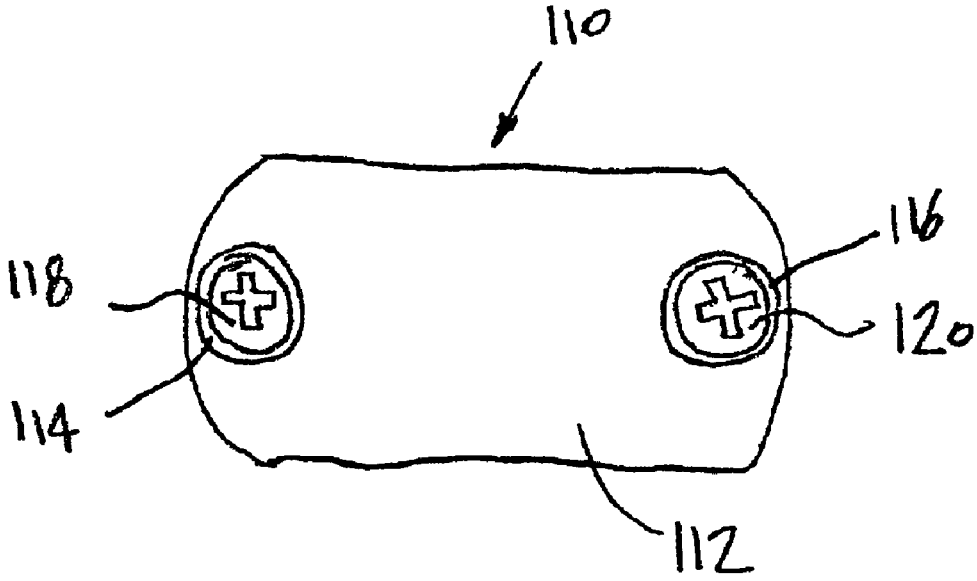
FIG. 7 is a front view of a retaining plate.

FIG. 7 shows a retaining plate 110 which is positioned within the backpack 12. The retaining plate 110 comprises a plate 112 having a pair of screw holes 114 and 116 for receiving screws 118 and 120, respectively. The screws 118 and 120 are adapted to screw into the screw holes 56 and 58 of the pivoting plate 54. When attached in this manner, the shoulder strap 10 is secured to the backpack 12 and the shoulder strap 10 is capable of pivoting or ratcheting motion or movement. In essence, by grasping and moving the shoulder strap 10, the tab portion 94 may be repositioned from one of the apertures 74 to another aperture 74 to adjust the shoulder strap 10 in a ratcheting or pivoting manner. The shoulder strap 26 is also capable of pivoting or ratcheting in this way.

Figure 8:
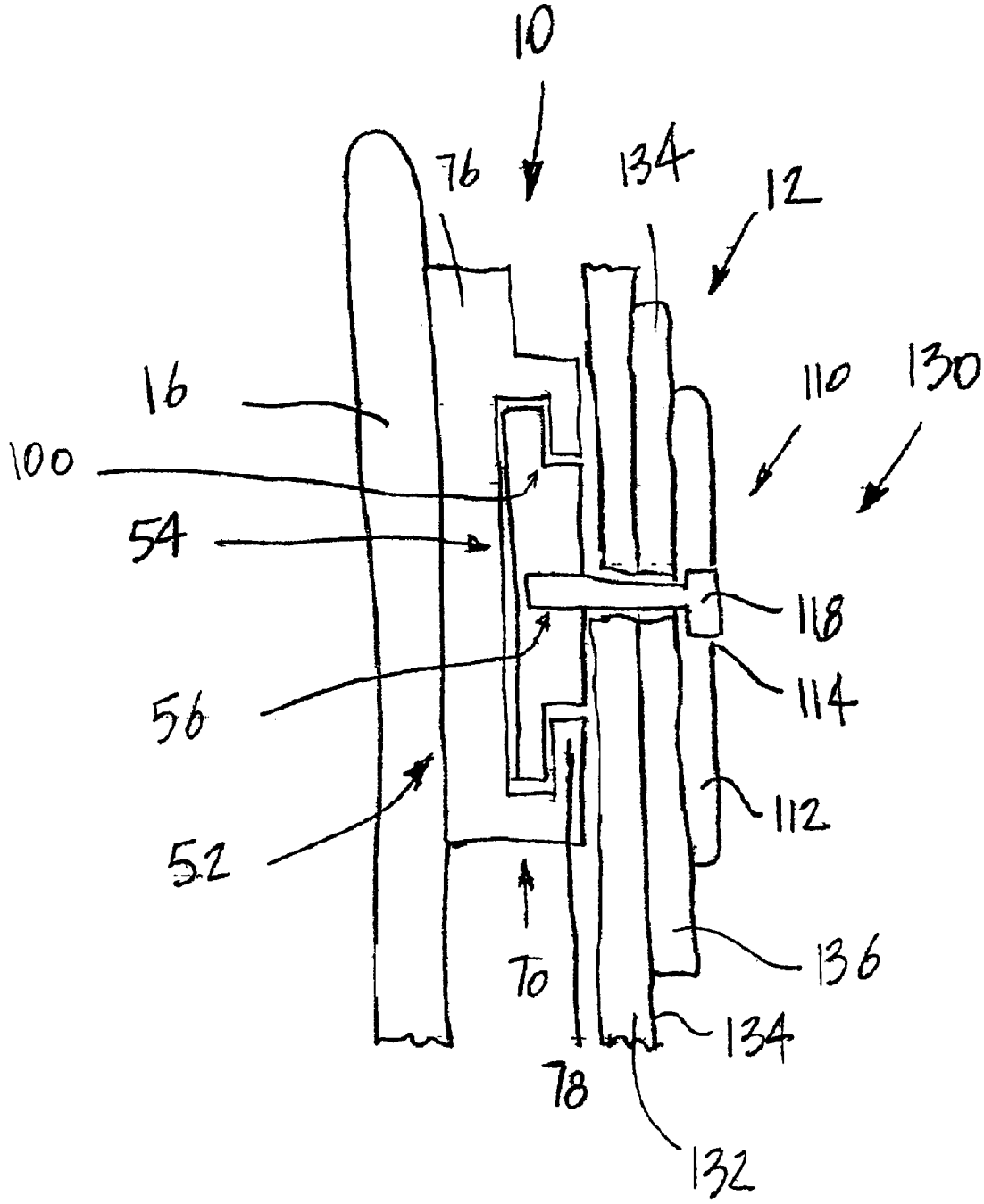
FIG. 8 is a partial cross-sectional view of the pivoting shoulder strap for a backpack constructed according to the present invention.

Referring now to FIG. 8, a partial cross-sectional view of the pivoting shoulder strap 10 and the backpack 12 and the manner in which the various components cooperate are shown. The base plate 52 is shown being attached to the upper portion 16. The pivoting plate 54 is captured within the outer retaining ring 70 and the lip 78 of the base plate 52 by the ledge 110 of the pivoting plate 54. The pivoting plate 54 is connected to the backpack 12 by use of the screw 118. The screw 118 has been inserted into the screw hole 114 of the plate 112 of the retaining plate 110. The screw 118 also screws into the screw hole 56 of the pivoting plate 54. The backpack 12 has an interior 130 that is formed by a portion of material 132 having an interior surface 134. The retaining plate 110 may be positioned directly on the interior surface 134. Additionally, interior 130 of the backpack 12 may include a reinforced section of material 136 and the retaining plate 110 may be located on the reinforced section 136. The material 132 and the reinforced section 136 may also include further reinforcement, such as a grommet.

As has been previously discussed, the pivoting shoulder strap 10 is capable of pivoting or ratcheting motion. The pivoting shoulder strap 10 may be grasped to move the shoulder strap 10 relative to the backpack 12. By moving the shoulder strap 10, the tab portion 94 is repositioned from one of the apertures 74 to another aperture 74 to adjust the shoulder strap 10 in a ratcheting or pivoting manner. The shoulder strap 10 may be moved from one of the apertures 74 to another of the apertures 74 or many of the apertures 74 may be bypassed to positioned the shoulder strap 10 in a desired position or orientation. The shoulder strap 26 is also capable of pivoting or ratcheting in this same manner. It is possible to move the shoulder strap 10 when the backpack is either on or off of an individual. The pivoting shoulder strap 10 also moves in a predictable or predetermined manner and does not jerk around the back or neck during use due to the pivoting or ratcheting mechanism 50. The backpack 12 can be adjusted when it is being worn or is off of an individual. The backpack 12 may be switched from one user to another with the adjustment of the shoulder straps 10 and 26 being easily accomplished.

It should be recognized that the pivoting shoulder strap 10 of the present invention can be constructed of various materials and can be assembled from separable components or formed as a unitary construction. Preferably, the pivoting shoulder strap 10, the base plate 52, the pivoting plate 54, and the retaining plate 110 will be constructed of relatively lightweight materials.

From all that has been said, it will be clear that there has thus been shown and described herein a pivoting shoulder strap for a backpack which fulfills the various objects and advantages sought therefor. It will become apparent to those skilled in the art, however, that many changes, modifications, variations, and other uses and applications of the subject pivoting shoulder strap for a backpack are possible and contemplated. All changes, modifications, variations, and other uses and applications which do not depart from the spirit and scope of the invention are deemed to be covered by the invention, which is limited only by the claims which follow.

What is claimed is:

1. A pivoting shoulder strap for a backpack comprising:

a retaining plate positioned within the backpack;

a shoulder strap having a first end and a second end, the first end adapted to being connected to the backpack; and a pivoting mechanism positioned on the second end of the shoulder strap and adapted to being mated to the retaining plate;

wherein the pivoting mechanism comprises a base plate and a pivoting plate retained within the base plate.

2. The pivoting shoulder strap of claim 1 wherein the base plate comprises a clip and apertures positioned around the clip, the pivoting plate comprises an aperture adapted to fit within the clip of the base plate, a tongue portion having a tab with the tab for mating with the apertures in the base plate.

3. A pivoting shoulder strap for a backpack comprising:

a retaining plate positioned within the backpack;

a shoulder strap having a first end and a second end, the first end adapted to being connected to the backpack; and a pivoting mechanism positioned on the second end of the shoulder strap and adapted to being mated to the retaining plate;

wherein the pivoting mechanism comprises a base plate and a pivoting plate retained within the base plate the pivoting plate having a pair of screw holes adapted for receiving screws, the retaining plate comprises a plate having a pair of screw holes each adapted for receiving a screw, with each screw being mated to the screw holes in the pivoting plate.

4. A pivoting shoulder strap for a backpack comprising:

a retaining plate positioned within the backpack;

a shoulder strap having a first end and a second end, the first end adapted to being connected to the backpack; and a pivoting mechanism positioned on the second end of the shoulder strap and adapted to being mated to the retaining plate;

wherein the pivoting mechanism comprises a base plate comprising a centrally positioned clip and apertures positioned around the clip, the apertures being positioned at predetermined intervals.

5. A ratcheting shoulder strap for a backpack comprising:

a retaining plate positioned within the backpack;

a shoulder strap having a first end and a second end, the first end adapted to being connected to the backpack; and a ratcheting mechanism positioned on the second end of the shoulder strap and adapted to being mated to the retaining plate, the ratcheting mechanism for moving the shoulder strap relative to the retaining plate in a predetermined degree of movement, wherein the ratcheting mechanism comprises a base plate and a pivoting plate retained within the base plate.

6. The ratcheting shoulder strap of claim 5 wherein the base plate comprises a clip and apertures positioned around the clip, the pivoting plate comprises an aperture adapted to fit within the clip of the base plate, a tongue portion having a tab with the tab for mating with the apertures in the base plate.

7. A ratcheting shoulder strap for a backpack comprising:

a retaining plate positioned within the backpack;

a shoulder strap having a first end and a second end, the first end adapted to being connected to the backpack; and a ratcheting mechanism positioned on the second end of the shoulder strap and adapted to being mated to the retaining plate, the ratcheting mechanism for moving the shoulder strap relative to the retaining plate in a predetermined degree of movement, wherein the ratcheting mechanism comprises a base plate comprising a centrally positioned clip and apertures positioned around the clip, the apertures being positioned at predetermined intervals.

8. A ratcheting shoulder strap for a backpack comprising:

a retaining plate positioned within the backpack;

a shoulder strap having a first end and a second end, the first end adapted to being connected to the backpack; and a ratcheting mechanism positioned on the second end of the shoulder strap and adapted to being mated to the retaining plate, the ratcheting mechanism for moving the shoulder strap relative to the retaining plate in a predetermined degree of movements, wherein the ratcheting mechanism comprises a base plate having an outer retaining ring.

9. A pivoting shoulder strap for a backpack comprising:

a retaining plate positioned in the backpack;

a shoulder strap having a first end and a second end, the first end adapted to being connected to the backpack; and a pivoting mechanism attached to the second end of the shoulder strap and adapted to being connected to the retaining plate, the pivoting mechanism comprising a base plate and a pivoting plate which is retained within the base plate, the pivoting mechanism for moving the shoulder strap relative to the retaining plate in a predetermined degree of motion.

10. The pivoting shoulder strap of claim 9 wherein the retaining plate comprises a plate having a pair of screw holes each adapted for receiving a screw, with each screw being mated to the pivoting mechanism.

11. The pivoting shoulder strap of claim 9 wherein the pivoting plate comprises a detent having a tab.

12. The pivoting shoulder strap of claim 9 wherein the base plate and the pivoting plate are constructed of high density polypropylene.

13. The pivoting shoulder strap of claim 9 wherein the base plate comprises a clip and apertures positioned around the clip, the pivoting plate comprises an aperture adapted to fit within the clip of the base plate, a tongue portion having a tab with the tab for mating with the apertures in the base plate.

14. The pivoting shoulder strap of claim 13 wherein the apertures are positioned at predetermined intervals around the clip.

15. The pivoting shoulder strap of claim 13 wherein the clip further comprises a pair of tabs which are used to retain the pivoting plate.

* * * * *

UNITED STATES PATENT AND TRADEMARK OFFICE

CERTIFICATE OF CORRECTION

PATENT NO. : 6,871,766 B2
DATED : March 29, 2005
INVENTOR(S) : Mark B. Nordstrom It is certified that error appears in the above-identified patent and that said Letters Patent is hereby corrected as shown below:

Column 6,
Line 56, delete the word "movements" and insert -- movement --.

Signed and Sealed this

Thirty-first Day of May, 2005

JON W. DUDAS
*Director of the United States Patent and Trademark Office*